United States Patent [19]

Suzuki et al.

[11] Patent Number: 4,505,946

[45] Date of Patent: Mar. 19, 1985

[54] METHOD FOR COATING METAL WITH A DISSIMILAR METAL

[75] Inventors: Michihiko Suzuki; Katsukiyo Kawaguchi, both of Tokai; Yoshihiko Kojima, Chita, all of Japan

[73] Assignee: Aichi Steel Works, Limited, Aichi, Japan

[21] Appl. No.: 325,903

[22] Filed: Nov. 30, 1981

[30] Foreign Application Priority Data

Dec. 2, 1980 [JP] Japan ..... 55-170093
May 12, 1981 [JP] Japan ..... 56-71068

[51] Int. Cl.[3] ..... B05D 1/04; B05D 1/06

[52] U.S. Cl. ..... 427/29; 427/185; 427/190; 427/319; 427/328; 427/427

[58] Field of Search ..... 427/26, 27, 29, 180, 427/185, 190, 191, 192, 226, 229, 240, 241, 242, 250, 252, 253, 327, 328, 329, 376.8, 331, 427, 374.1, 318, 319

[56] References Cited

U.S. PATENT DOCUMENTS

| | | | |
|---|---|---|---|
| 2,990,293 | 6/1961 | Toulmin | 427/29 |
| 3,019,126 | 1/1962 | Bartholomew | 427/29 |
| 3,949,122 | 4/1976 | Lepetit et al. | 427/253 |
| 3,996,400 | 12/1976 | Caubet | 427/253 |

FOREIGN PATENT DOCUMENTS

| | | | |
|---|---|---|---|
| 536973 | 2/1957 | Canada | 427/253 |
| 542798 | 6/1957 | Canada | 427/253 |
| 43-8161 | 3/1968 | Japan | 427/190 |
| 49-33253 | 9/1974 | Japan | 427/327 |
| 55-31164 | 3/1980 | Japan | 427/431 |
| 55-23910 | 6/1980 | Japan | 427/327 |
| 762418 | 7/1953 | United Kingdom | 427/253 |

*Primary Examiner*—S. L. Childs
*Attorney, Agent, or Firm*—Parkhurst & Oliff

[57] ABSTRACT

A method for coating metal with a dissimilar metal which comprises heating a parent metal at a temperature at which substitution of a halide metal for said parent metal occurs or a higher temperature while directly contacting the powdered halide metal with the surface of said parent metal to effect the substitution reaction of said halide metal, then cooling the resulting product, and removing the residue from said product.

6 Claims, 1 Drawing Figure

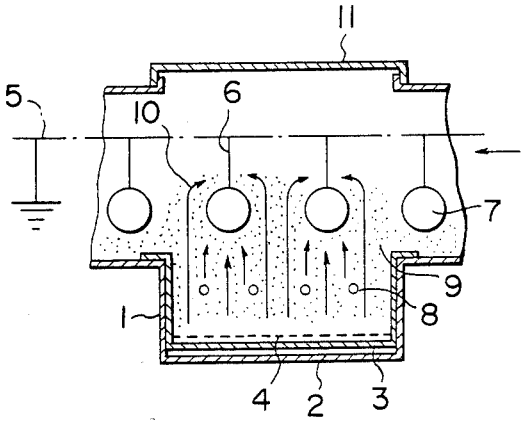
11
5
10
6
7
9
8
1
4
2
3

METHOD FOR COATING METAL WITH A DISSIMILAR METAL

BACKGROUND OF THE INVENTION

This invention relates to a method for coating metal with a dissimilar metal.

In general, it is well known that as a method for coating a parent metal such as aluminum with a dissimilar metal such as copper, there has been proposed such a method in which a pretreatment for removing an oxide film firmly produced on the surface of a parent metal is effected in an aqueous solution then substitution of heavy metal such as zinc, nickel, tin or the like for the oxide film is carried out to form a layer for coating its substrate; and electroplating or electroless plating is applied onto the resulting layer coated for the substrate. In such method, however, it is necessary to repeat etching steps by means of various acids or alkalis and rinsing steps many times, so that the operations become very complicated. Furthermore, the coated layer for the substrate obtained by this method has an inferior adherence to its parent metal, and there are many problems in corrosion resistance. Thus, in order to overcome such problems, methods for coating the surface of a parent metal with a dissimilar metal by utilizing a dry substituting reaction such as gassing, dipping, spreading, coating or the like process which will be described hereinbelow have heretofore been proposed.

As disclosed, for example, in Japanese Patent Publication No. 33253/74 "Process for the Production of a Composite Metallic Material of Aluminum or the Alloy Thereof", a conventional gassing process is characterized by preheating aluminum or an alloy thereof at a temperature of 350° C.–600° C., contacting the aluminum alloy thus preheated with a halide metal gas generated by heating an admixed halide metal together with a flux, reducing and removing the surface layer of the aluminum alloy, and at the same time diffusing and cementing a dissimilar metal in the halide metal gas on the aluminum alloy.

However, such a conventional gassing process has the following disadvantages (1)–(4). That is, (1) since a container for a fused salt which is utilized for gasifying a halide metal is made of metal or ceramics, there are many cases where a container made of ordinary metal cannot be used because of its remarkable corrosion. In the case of a ceramics container, it is difficult to manufacture a large container by the use of ceramics only. Accordingly, such a ceramics container must be constructed by means of ceramics blocks, but in this case a high protective technique against corrosion is required in the masonry joint. Furthermore, there is a large possibility that the masonry joints would be damaged by means of expansion and shrinkage of the halide metal in intermittent operation. (2) Jigs and other equipment or devices employed in the atmosphere gasified are remarkably attacked and wasted. (3) A rate of evaporation is very slow in a step for evaporating a halide metal by heating the same at the melting temperature thereof or more, so that it becomes a rate-determining factor for producing a coated layer and results in an unfavorable productivity rate. (4) It is necessary to provide an inert atmosphere such that the halide metal gas itself is not oxidized as the gas atmosphere.

As described, for instance, in Japanese Patent Laid-open No. 31164/80 "Process for the Production of Stainless Steel Coated with Copper", a conventional dipping process is characterized by dipping austenitic stainless steel in a molten bath of copper chloride containing an excess of copper and having a temperature of 450° C.–700° C. in a method for forming a copper coated layer on the surface of the austenitic stainless steel.

However, such a conventional dipping process involves the following disadvantages (1)–(2). Namely, (1) containers, jigs, and other equipment are readily corroded. (2) In the case when a metal coated with a dissimilar metal is withdrawn from a salt bath of halide metal after the completion of the reaction, the halide metal excessively adhered to a parent metal is carried away from the bath, so that loss of the halide metal increases. The halide metal thus brought out is discarded at the time of rinsing the parent metal so that it comes to nothing, and at the same time it requires much labor for such rinsing operation.

In the gassing and dipping processes as mentioned above, a halide metal is used in the gaseous or liquid form. Therefore, either process relates to the one in which a parent metal is directly contacted with the halide metal even without employing a binder to cause reaction in a hot condition, whereby the surface of the parent metal can be coated with a dissimilar metal.

However, since both of these processes have the above stated drawbacks, such a coating process by the use of a binder as described hereinbelow is practically utilized.

As disclosed, for instance, in Japanese Patent Publication No. 8161/68 "Process for Forming a Pinhole-free Alloy Layer on the Surface of a Parent Material of Aluminum or the Alloy Thereof", a conventional spreading process is characterized by comprising a first step of applying thinly an adherent material among hydrocarbons on the surface of an aluminum alloy of a parent material as a binder, a second step of spreading and permitting fine powders of a halide metal to adhere on the surface of the parent material after completing the first step, and a third step of heating the resulting product through the second step at a temperature at which aluminum halide sublimes in a furnace or a higher temperature and thereafter removing heat from the product.

However, such conventional spreading process involves also the following disadvantages (1)–(4). That is, (1) the process requires a binder for holding and permitting a halide metal salt to adhere to the surface of a parent metal. Further, a step for applying the binder to the surface of the parent metal is independently necessary for this process. Besides it is technically difficult to control the uniform application of the binder on only a necessary portion of the surface of the parent metal in proper quantities, in spite of the fact that the binder is in liquid- or paste-form. In addition, it is finally required to remove the binder from the product, resulting in increased loss in heating, and much labor is also necessary for the after-treatment. (2) The control of the amount of the halide metal spread and adhered onto the surface of the parent metal or the like operation is also technically very difficult in relation to the amount of the binder spread and the particle size of the halide metal. Especially, it is substantially impossible to control the spread or the like of the binder on the basis of the target thickness of the coated layer in its final product. Accordingly, an excessive binder is always spread in actual production. (3) The process requires heating of the parent metal under such condition that the binder and halide metal are permitted to adhere to the parent metal, so that the selection of heating method is restricted. Generally, the heating is effected by means of convection or radiation, but in such a heating method, it is very difficult to uniformly set a temperature rise in each portion of the surface of the parent metal to be treated. As a consequence, it results in dispersion at a time for starting reaction in each portion of the surface of the parent metal to be treated, so that there occurs scatter in the finish coated layer. (4) With the decrease in viscosity of the binder in the heating step, the degree of adhesion decreases so that the halide metal comes away and sags or runs, resulting in a nonuniform coated layer.

As disclosed, for example, in Japanese Patent Publication No. 23910/80 "Process for Coating the Surface of Aluminum or an Aluminum Alloy Parent Material with a Metal Layer", a conventional coating process is characterized by: uniformly coating the surface of the aluminum alloy parent material with a coating fluid prepared by adding a halide metal to be coated to a dispersion consisting of a hydrophobic solvent, aliphatic non-polar polymer and at least one trivalent alkyl amine; heating the aluminum alloy parent material thus coated at a temperature at which aluminum halide sublimes or a higher temperature to cause a substitution reaction between the halide of the metal to be coated and aluminum; and sublimating the aluminum halide thus produced, whereby a coated layer of a dissimilar metal is formed on the surface of the parent material.

However, such a conventional coating process involves the following drawbacks (1)–(4). Namely, (1) since the process requires previous preparation of a coating fluid consisting of a halide metal and binder, a particularly and highly skilled manner is necessary for kneading the halide metal with binder, and a homogeneously kneaded dispersing state cannot be obtained if an especially expensive dispersant is not used. Besides it is necessary that the properties of the coating fluid are always controlled in response to those required in a manner of coating in order to obtain a uniform coated layer. (2) Heating of the parent material coated with the coating fluid brings about nonuniformity in a distribution of temperature in case of, particularly, rapid heating, and it results in scatter in the quality of a product as in the case of disadvantage (3) of the aforesaid spreading process. (3) Even if a uniform coating was made on the surface of the parent material, sags and runs of the halide metal due to decrease of viscosity of the binder in the heating step cannot be avoided. Consequently, it is necessary to excessively coat the coating fluid by making allowance for a loss due to the sags and runs thereof. As a result, an amount of the halide metal on a treated surface of the parent material becomes finally nonuniform and scatter is generated in respect of the quality of the product. (4) Excessive energy and time are required for decomposing and removing the binder.

SUMMARY OF THE INVENTION

It is an object of the present invention to eliminate the disadvantages mentioned above in conventional methods of dissimilar metal coating and to provide an improved dissimilar metal coating method which requires no highly developed equipment as well as no use of a binder or the like, whilst the productivity rate in the method is excellent, and the quality of the product treated by the method is excellent.

In accordance with the present invention, there is proposed a method for coating metal with a dissimilar metal characterized by heating a parent metal at a temperature at which substitution of a halide metal for the parent metal occurs or a higher temperature while directly contacting the powdered halide metal with the surface of the aforesaid parent metal to carry out the substitution reaction of the halide metal, then cooling the resulting product, and removing the residue from the aforesaid product.

According to an embodiment of the present invention, there is proposed a method which comprises exposing a parent metal, heated to a temperature at which substitution of a halide metal for the parent metal occurs or a higher temperature, to an atmosphere in which the finely powdered halide metal floats to carry out the substitution reaction of the halide metal, then cooling the resulting product, and removing the residue from the aforesaid product.

According to another embodiment of the present invention, there is further proposed a method which comprises permitting a powdered halide metal being a dissimilar metal to adhere onto the surface of a parent metal by means of static electricity, heating the resulting parent metal with the halide metal to a temperature at which substitution of the halide metal for the parent metal occurs or a higher temperature to carry out the substitution reaction of the halide metal, then cooling the resulting product, and removing the residue from the aforesaid product.

In the method of the present invention, a powdered halide metal is heated to a temperature at which substitution of the halide metal for a parent metal occurs or a higher temperature while directly contacting the powdered halide metal with the parent metal, and hence a direct reaction between the parent metal and a dissimilar metal can be achieved without employing a binder, unlike conventional method.

Thus, a suitable heating manner which does not harm equipment and the like can be adopted in the method of the present invention, so that there is an advantage in that expensive equipment or devices, etc., are not required in the method.

According to the method of the present invention, since a halide metal is directly reacted with a parent metal without using a binder, coating fluid or the like, a coated layer of a dissimilar metal with a uniform surface and excellent adhesive strength can be formed on the parent metal.

BRIEF DESCRIPTION OF ATTACHED DRAWING

The FIGURE is a sectional view showing a state in which a parent metal is exposed to an atmosphere of floating finely powdered halide metal prepared by the use of static electricity in the practice of one embodiment of the method according to the present invention.

DESCRIPTION OF PREFERRED EMBODIMENTS

This invention relates to a method for coating metal with a dissimilar metal which comprises heating a parent metal to a temperature at which substitution of a halide metal for the parent metal occurs or a higher temperature, while directly contacting the powdered halide of metal to be coated such as copper chloride or bromide in the case of forming a copper coated layer, or tin chloride or iodide in the case of forming a tin coated layer on the surface of the parent metal such as iron, aluminum or the like, thereby effecting the substitution reaction of the halide metal for the parent metal; thereafter cooling the resulting product, and removing the residue from the aforesaid product.

In embodying the method of the present invention, it is required to homogeneously contact a powdered halide metal with the surface of a parent metal. Thus, as a preferred manner for attaining such homogeneous contacting is, for instance, a manner in which a parent metal is exposed to an atmosphere wherein a finely powdered halide metal floats, or a manner in which a powdered dissimilar halide metal is allowed to adhere to the surface of a parent metal by means of static electricity.

In the method of this invention, a finely powdered halide metal is directly contacted with the surface of a parent metal without employing any binder, thus differring from conventional spreading and coating processes. As contacting manners which can replace the manner wherein a binder is utilized, there are, for example, a fluidized bed, spraying, dusting, use of static electricity, a common method for affording mechanical vibration of the powder, and the combinations thereof. In the method of the invention, the aforesaid finely powdered halide metal is reacted with the above stated parent metal at elevated temperatures. In this case, the elevated temperatures are required to be such a temperature at which substitution reaction of the halide metal for the parent metal occurs or a higher temperature. For instance, it is required to heat aluminum parent material at a temperature of 370° C. or more in the case where cuprous chloride is reacted with the aluminum parent material. Heating at such elevated temperatures may be accomplished before or after the halide metal contacts the parent metal so far as the halide metal reacts with the parent metal. Thus, in accordance with the method of the present invention, coating of the parent metal with a dissimilar metal cn be achieved without employing any binder. For this reason, binder material can be saved, and energy can also be saved, because no thermal decomposition of such binder is required in this method. Furthermore, there is no residual portion of the binder in the reaction residue, so that the removal of the residue is easy.

In addition, according to the present invention, there is no possibility that the equipment would be corroded by gas or liquid of a halide metal, differring from a conventional gassing or dipping process in which a binder is employed. Accordingly, there is no need for constructing such equipment from a corrosion-resistant material, so that the cost for coating equipment and maintenance cost become inexpensive, and the control for maintenance or repair in respect of such equipment can very easily be carried out.

First of all, the present invention will be described in detail hereinbelow in connection with an embodiment of the method in which a parent metal is exposed to an atmosphere where a finely powdered halide metal floats.

This embodiment of the method comprises a first step for previously heating a parent metal at a temperature at which substitution of a halide metal for the parent metal occurs or a higher temperature, a second step for exposing the parent metal thus heated to an atmosphere in which the finely powdered halide metal floats, and a third step for cooling the parent metal the surface of which has already been substituted by the halide metal and removing the residue therefrom. These steps will be further described in more detail hereinbelow.

The first step is, as stated above, the one for heating previously the parent metal at a temperature at which substitution of the halide metal for the parent metal occurs or a higher temperature. In this case, the parent metal is metal such as iron, titanium, aluminum or the like, or an alloy thereof, whilst the halide metal is a compound such as copper chloride, tin chloride, zinc chloride, tin iodide, copper bromide, silver fluoride or the like. In this case, it is to be noted that the metal of such a halide metal is dissimilar to the parent metal to be combined therewith.

The temperature for heating the parent metal in the first step is required to be such a temperature at which substitution of the halide metal for the parent metal arises or a higher temperature. For instance, an aluminum parent material must be heated at a temperature of 370° C. or more in the case where cuprous chloride is reacted with the aluminum parent material. Setting such a heating temperature for a parent metal is an indispensable matter to make a halide metal reactive with the surface of the parent metal by merely contacting or allowing a solid (fine powder) of the halide metal, which is in a floating condition by means of a spraying, jetting, dusting, electrostatic adhering process or the like, to adhere to the parent metal in the following second step. Furthermore, if a flux is used in the first step, it is possible to drop the temperature at which the substitution reaction of the halide metal for the parent metal arises. For example, in the above case of reacting cuprous chloride with an aluminum parent material, when a fine powder of 45% ammonium chloride-50% cuprous chloride is employed, it becomes possible that the substitution of the halide metal for the parent metal is made by maintaining the aluminum parent material under the heating condition of a temperature of around 300° C.

As a heating manner for such parent metal, any manner of convection, radiation, and conduction heating may freely be selected. Furthermore, it is also possible to utilize remaining heat in a rolling or extruding process for a parent metal. Besides such arrangement that a parent metal is previously heated in a chamber where fine powder of a halide metal is to be floated, the fine powder of halide metal may be succeedingly floated therein, and the parent metal exposed to such atmosphere of the floating finely powdered halide metal after heating.

A parent metal is heated as mentioned above and, if a contamination with working oil, dust or the like which has adhered on the surface of the parent metal prior to this heating step is previously degreased and washed away to clean the surface of the parent metal, it becomes easily possible to obtain a metallic layer of a good quality as mentioned below. Namely, it is preferable that a parent metal has been degreased and washed prior to the heating step; but it is to be understood that a metallic layer of an ordinary quality can be obtained in the case of, for example, an oil-stained parent metal which wherein such oil stain is removed by means of evaporation, decomposition or combustion in the course of the above stated heating step, even though no particular degreasing and washing treatments are applied thereto.

Next, the second step is the one for exposing the heated parent metal to the atmosphere where the finely powdered halide metal floats to directly contact the finely powdered halide metal with the parent metal. Even if there exist particles having a particle size of more than 500μ in the finely powdered halide metal, the particles in the floating process frictionally contact or collide with each other to be finely divided. However, according to the experimental results by the present inventors, it is preferable to arrange a particle size of the finely powdered halide metal such that 90% or more of the powdered halide metal has a particle size of 500μ or less in order to maintain a favorable floating condition of the halide metal. Such atmosphere in which a finely powdered halide metal floats is obtained by means of a customary manner such as a fluidized bed, spraying, dusting, electrostatic, mechanically vibrating process, or a combination thereof, etc.

The temperature of such halide metal floating atmosphere may either be room temperatures, or one which is obtained by heating a halide metal at a temperature lower than the melting point thereof. When the floating atmosphere is set to a warmed condition in the above latter case, moisture absorption of the halide metal to be used is prevented, so that a favorable floating condition can be maintained. The rate of temperature drop can decrease to promote a rate of reaction of the halide metal with the parent metal, and it results in reduction in exposure time of the parent metal with respect to the finely powdered halide metal atmosphere, so that the productivity rate thereof can be elevated. In the case where there is a fear that the halide metal itself will be oxidized by means of oxygen in the air due to the temperature of the halide metal floating atmosphere, an inert gas such as argon, nitrogen or the like may be employed so that oxidation of the halide metal itself can be prevented.

The amount of a halide metal adhered to the surface of the parent metal is controlled dependent on floating condition, exposure time, and temperature of the parent metal. For instance, the amount of cuprous chloride to be adhered to the surface of aluminum must be at least 0.3 $g/dm^2$ in the case where cuprous chloride is reacted with the surface of aluminum to achieve a copper coating.

FIG. 1 is an explanatory view showing one embodiment of the method according to this invention for exposing a parent metal to a finely powdered halide metal atmosphere prepared by the use of static electricity in which a lower electrode 2 is disposed on the bottom part of an exposure box 1, and an upper electrode 4 is placed on the upper part of the lower electrode 2 through an insulating sheet 3. A hanger 6 suspended from a conveyor 5 being grounded is arranged in the upper part of the exposure box 1 so as to hold a parent metal 7, and such hanger is also arranged to be transferable from the right to left side in the drawing. A fine powder of halide metal 9 supplied from a nozzle 8 for supplying powder provided in the exposure box 1 falls to the bottom part of the exposure box 1 to be charged by the electrodes, so that the halide metal fine powder comes to be floatable in the direction of an electric line of force 10 indicated by an upward arrow. The exposure box 1 is further provided with an upper cover 11. In this arrangement, the parent metal 7 heated beforehand is suspended by means of the hanger 6 attached to the conveyor 5. When such parent metal 7 is passed through the interior of the exposure box 1 in which the fine powder of the halide metal 9 supplied from the powder supplying nozzle 8 is in a floating condition along the line of electric force 10, it becomes possible to directly contact the parent metal 7 with the fine powder of halide metal 9.

In the case when only a part of the parent metal is exposed to a halide metal floating atmosphere so that it is intended to obtain a partial coating of a dissimilar metal on the surface of the parent metal, a masking is beforehand applied to the part of the surface of the parent metal not to be coated. Such masking can easily be effected by utilizing a metallic tape which is adapted to the shape of the parent metal.

For attaining a sufficient substitution of a halide metal for the parent metal or a further diffusion of a coating metal to the interior of the parent metal, it is effective to heat the parent metal succeeding to the exposure of the parent metal to the halide metal floating atmosphere as mentioned above. Moreover, the second step is not only effected by exposing a parent metal after being heated to a finely powdered halide metal floating atmosphere, but also by contacting the powdered halide metal with the parent metal, which has already been heated to a temperature at which the aforesaid substitution arises, by means of spraying, dusting, blowing, static electricity or the like while continuing the heating of the parent metal.

Finally, the third step is the one for cooling the parent metal, the surface of which has been substituted by the halide metal in the above second step, and removing the residue of the substitution reaction product or unreacted residue from the surface of the parent metal, whereby the parent metal coated with the required dissimilar metal is obtained. In this case, cooling of the parent metal may be carried out by either taking the parent metal out from the finely powdered halide metal floating atmosphere, or eliminating the halide metal floating atmosphere and air-cooling or water-cooling the parent metal at that place.

In the method as set forth above, a parent metal which is heated at a temperature at which substitution of a halide metal for the parent metal occurs or a higher temperature is exposed to an atmosphere where the fine powder of halide metal floats to directly react the halide metal with the parent metal without employing any binder. Accordingly, a suitable heating manner which does not harm the equipment and the like can be selected, so that there is no need for highly developed equipment and the like in this method. A halide metal is directly reacted with a parent metal by using no binder, coating fluid or the like, whereby the parent metal having a homogeneous coated layer of a dissimilar metal can be obtained.

More specifically, the method of one embodiment according to the invention has the advantages as described hereinbelow.

(1) Heating of a parent metal in the first step is the one which is to be applied to the parent metal onto which a halide metal has not yet been permitted to adhere. Consequently, the heating manner is not restricted in this case and an optimum manner can freely be selected among various heating manners by taking an efficiency, cost, time, uniformity of temperature and the like in respect of such heating into consideration, so that the method can contribute to elevation in quality of the product, saving of energy, elevation in productivity rate and the like.

(2) Since the parent metal onto which a halide metal has not yet been permitted to adhere is heated as described above, it becomes easy to make the temperature of the parent metal uniform, so that it is possible to make the rate of reaction as well as the amount of reaction between the parent metal and halide metal in the following second step uniform. As a consequence, a product having a homogeneous coating condition, good luster, favorable physical properties and the like can be obtained.

(3) The whole surface of the parent metal may be heated, so that a halide metal can be contacted and reacted with the whole surafce of the parent metal in the successive second step.

(4) Since a device or container utilized for heating the parent metal is not exposed to the halide metal at elevated temperatures, such device or container is not corroded or damaged.

(5) The second step is the one for exposing the parent metal which has beforehand been heated uniformly to an atmosphere where a halide metal floats. Hence the halide metal can be permitted to uniformly adhere to the surface of the parent metal by controlling the heating temperature, floating condition and the like, even if the parent metal has complicated concave or convex portions on the surface thereof. Since the parent metal directly contacts and reacts with the halide metal after the parent metal has passed through the heating step, there is no possibility of sagging and running or falling-off of the halide metal prior to the reaction, unlike a conventional spreading or coating process, so that the yield and quality of the product increase.

(6) The rate of adhesion of the halide metal onto the parent metal is not restricted by rate of evaporation as in a conventional gassing process. As a consequence, speeding up of operations in the method becomes possible by controlling the amount of floating halide metal, so that the productivity rate can be elevated.

(7) The amount of adhesion of halide metal onto the parent metal can arbitrarily be controlled by adjusting the amount of floating halide metal, exposure time or the like. Accordingly, only a required minimum amount of the halide metal can be allowed to uniformly adhere on the parent metal, so that there is no wastage of the halide metal, and it results in an easy washing operation in the third step.

(8) Since a solid of a finely powdered halide metal is in such state that it is ready for adhering to a required parent metal by means of spraying, jetting, dusting, electrostatic adhering or the like process, there is no problem dissimilar to a conventional gassing, dipping or the like process in view of the operations and equipments. Namely, a container or bath used as equipment for the coating process is remarkably corroded by vapor or fused salt liquid of a halide metal in a conventional gassing or dipping process in which vapor or liquid of the halide metal is utilized. Thus, considerable expense, time and efforts are necessary for the repair, maintenance and control of the equipment during operation. On the other hand, since a solid of the halide metal is floated in the present invention, particularly there is no generation of corrosion in the container for floating the halide metal or other environmental portions, so that maintenance, repair and control for the coating equipment can very easily be effected, and there is no need for constructing such equipment for coating by use of a corrosion-resistant material.

(9) Since a fine powder of halide metal contacts directly with the parent metal, there is required no binder, unlike a conventional spreading or coating process. Therefore, a preparation of such binder with the halide metal and a coating operation of the binder come to be not necessary and consequently, selection of the material of, or preparation of such binder, or equipment, operating time and the like for coating the binder needless in the method of the present invention, so that simplicity of the operations can be attained. Moreover, since the fine powder of halide metal reacts directly with the parent metal without any interposition of such binder between the halide and parent metals in this method, peeling, blister or the like of a coated metal produced on the surface of the parent metal is remarkably reduced and substantially no pelling, blister or the like is observed.

(10) Moreover, since a halide metal directly contacts with the previously heated parent metal so that no binder is required, the substitution reaction is rapidly achieved, and the residue to be treated in the third step decreases. Further such residue cam simply be released and hence an operation for removing the residue can easily and instantly be carried out.

(11) Finally, the coated layer produced on the parent metal consists of a thin film of a dissimilar metal formed on the surface layer of the parent metal and a diffused layer produced by the diffusion of the dissimilar metal into the parent metal beneath the thin film. For this reason, the bonding between the dissimilar metal thin film and parent metal comes to be firm, so that disadvantages such as peeling, blister and the like of the dissimilar metal scarcely arise. Therefore, a plated layer of the products in the method of the present invention scarcely peels as compared with a plated layer obtained by ordinary electroplating, electroless plating or the like in the succeeding press workings such as cutting, bending, punching or the like and thus, the products of the invention have an excellent workability. In this respect, there is such a case that the plating step must be arranged after the press working step in a conventional plating process, whilst a press working or the like can be carried out after coating a parent metal with a dissimilar metal in the present invention.

Copper, nickel, tin or the like may be applied on the coated layer of a parent metal formed in accordance with the method of this invention by means of electroplating, electroless plating or the like, if required. Addition of such a plating step results in a very favourable adhesion of a finish plated metal and can bring about excellent corrosion resistance in the products.

The method of the present invention is applicable for a parent metal having various shapes, dimensions and the like, particularly a parent metal with such shape that the temperature of the parent metal is liable to be nonuniform by means of usual heating. This is because the parent metal with such shape is also uniformly heated beforehand, and then a dissimilar metal is reacted with the parent metal thus uniformly heated, so that a homogeneous coating can be effected on the parent metal in the method of the invention.

Results of specific experiments of the method for coating metal with a dissimilar metal according to the present invention will be described hereinbelow.

In a first experiment, an aluminum plate of $10\times100\times200$ mm as specified in JIS-A1100 was inserted into a fluidized reactor at a temperature of 430° C. in which aluminum powder is employed and held for 2 minutes, thereby to uniformly heat the aluminum plate, and then the aluminum plate was taken out from the fluidized reactor. The aluminum plate thus heated was immediately placed in a tank in which a cuprous chloride powder passed through 200 mesh sieve (being 74μ or less in particle size) is floated with nitrogen gas at a temperature of 150° C. and maintained for 30 seconds, whereby the cuprous chloride powder was permitted to adhere to and react with the aluminum plate in a ratio of 0.8 g/dm$^2$. Thereafter the resulting aluminum plate was taken out from the tank for floating the cuprous chloride powder, and cooled and washed to remove the residue. In accordance with the first experiment, cuprous chloride was directly reacted with the aluminum plate without employing any binder, and as a result a copper coated surface consisting of 2–3μ thin film-like copper layer could be formed on the aluminum plate. In this experiment, a short period of time, i.e., 3 minutes, was required for the treatment, there was no corrosion on the tank, and the reaction residue could be removed by simple washing with water.

In a second experiment, an austenitic stainless steel plate of 5×50×100 mm as specified in JIS-SUS304 was heated for 20 minutes in an electric furnace containing argon gas atmosphere at 700° C., and then the stainless steel plate thus heated was taken out from the electric furnace. A cuprous chloride powder passed through 40 mesh sieve (being about 420μ or less in particle size) was immediately dusted on the stainless steel plate thus taken out from the furnace in a ratio of 3 g/dm$^2$, then after 5 minutes, the so dusted stainless steel plate was water-cooled and washed to remove the residue. Also in the second experiment, cuprous chloride was reacted with the stainless steel plate without using any binder, whereby a copper film of about 3μ could be formed on the surface layer of the stainless steel plate, and washing of the residue could also be simply effected.

In a third experiment, an aluminum alloy plate of 8×50×400 mm as specified in JIS-A2014 was subjected to infrared heating, and when the temperature of the aluminum alloy plate reached each temperature shown in the following Table 1, all of which being 400° C. or more, the so heated aluminum alloy plate was exposed to an atmosphere in which a fine powder of cuprous chloride is spattered and atomized by the use of static electrolysity, thereby generating substitution of cuprous chloride for the aluminum alloy. In this case, both manners such as the one in which the cuprous chloride atmosphere is prepared in the same chamber as that utilized for heating the alluminum alloy plate and the other one in which a separate chamber is utilized for preparing the cuprous chloride atmosphere from that for heating the aluminum alloy plate were examined. As a result, each copper thin film having essentially no difference could be formed in respect of both the manners as shown in Table 1. Furthermore, in order to examine the properties of these copper thin films, a copper electroplated coating of 50μ was further applied on the aforesaid copper thin film, and then the resulting product was subjected to a salt-spray test. As a consequence, there was neither blister nor pinhole, but a favorable quality was observed in the resulting product.

TABLE 1

| Heating Temperature (°C.) | Thickness of Copper Coating: Contact by Spattering and Atomizing for 20 sec. Same Chamber (μ) | Separate Chamber (μ) | Remarks |
|---|---|---|---|
| 400 | 2–3 | 1.5–3 | Stopped heating when reached 400° C. |
| 450 | 3–4 | 3–4 | Stopped heating when reached 450° C. |
| 500 | 3.5–5 | 3.5–4.5 | Stopped heating when reached 500° C. |
| 520 | 4–6 | 4–6 | Stopped heating when reached 520° C. |
| 420–450 | 3–4 | — | Started dusting when reached 420° C., and stopped heating and dusting when reached 450° C. |

As described above, the present invention concerns a method for coating metal with a dissimilar metal which comprises preheating a parent metal at a temperature at which substitution of a halide metal for the parent metal occurs or a higher temperature, exposing the parent metal thus preheated to an atmosphere where the finely powdered halide metal floats to effect the substitution reaction, then cooling the resulting product, and removing the residue from the aforesaid product. Hence, in the method of the invention, a suitable heating manner which does not harm to equipment, apparatus, operations and the like can be selected, so that highly developed equipment, apparatus or the like is not required. In addition, the method of this invention has such advantage in that a metallic product having a homogeneous dissimilar metal coated thereon can be obtained by directly contacting a halide metal with a parent metal without using any binder, coating fluid or the like, so that the productivity rate thereof can be elevated.

Next, another embodiment of the method for coating metal with a dissimilar metal according to the present invention will be described in detail hereinbelow.

The embodiment stated hereunder is characterized by adopting a step for permitting a powdered halide metal to adhere on the surface of the parent metal by means of static electricity in place of the aforesaid step for exposing a parent metal to an atmosphere in which a finely powdered halide metal floats.

In this embodiment, metal such as iron, titanium, aluminum or the like, or an alloy thereof, may be employed as the parent metal as in the above-mentioned embodiment.

First of all, the parent metal is degreased and washed as its pretreating step. In order to obtain a stable high-quality metallic coating, it is preferable to clean contamination with working oil, dust or the like adhered on the surface of the parent metal by previously degreasing and washing the parent metal. However, in the case where the surface of the parent metal is contaminated with merely an oily matter, such oily matter can be removed by evaporating, decomposing or burning off the same by means of the heating during a step for coating the parent metal with a dissimilar metal. Therefore, the pretreating step such as degreasing and washing may be omitted in this case.

After confirming that the surface of the parent metal has been cleaned, a step for allowing a finely powdered halide metal of a dissimilar metal to adhere onto the surface of the parent metal by means of static electricity is applied to the parent metal. Such adhesion of a powdered metal is practised without employing any binder in this method, thus differing from the conventional method.

A halide metal is permitted to adhere on either the whole or a partial surface of the parent metal. In the case where a partially coated product is desired masking is beforehand applied to the portion on which a metallic coating is not contemplated. As a manner for such masking, a usual manner such that a metallic or resin masking tape or the like is applied to the surface of the parent metal so as to fit the tape on the shape thereof may be adopted.

As the halide metal, for instance, copper chloride, tin chloride, zinc chloride, tin iodide, silver bromide, silver fluoride or the like may be employed as in the case of the aforesaid embodiment. In this case, it is to be noted that the metal of the halide metal differs from the parent metal.

In the case when such a halide metal is permitted to adhere to the surface of the parent metal by means of static electricity, it is preferable that the electrical resistance of such halide metal is $10^7$ ohm.cm or more. For example, cuprous chlorides among the aforesaid copper chloride has an electrical resistance of $1.89\times10^7$ ohm.cm at 45° C.

In adhering a halide metal by means of static electricity, an electrostatic powder gun, an electrostatic fluidized bed dipping process, an electrostatic spattering process or the like process may be adopted. In this respect, a more suitable manner can be selected in accordance with the shape of the parent metal. Furthermore, it is preferable that the particle size of the finely powdered halide metal is 300μ or less.

The adhesive force of a halide metal onto the parent metal varies dependent upon the value of electrical resistance or the like of the halide metal, but such adhesive force is required to possess such an extent that the halide metal is held on the surface of the parent metal until a heating step for forming a metallic coating is completed with little falling-off of the halide metal, or a higher force.

In a case where a sufficient adhesive force is not obtained, for example, a case where there is a fear of dropping the halide metal once adhered to the surface of the parent metal due to gravity, shock at the time of handling the parent metal or the like, a countermeasure for increasing adhesive force may be practised according to necessity. As an example of such a counter-measure for increasing adhesive force, there is a method in which a second material having a high adhesive force is employed. As the second material, for example, a fine powder of aluminum oxide or silicon oxide can be utilized. In this case, it is required that the second material does not interfere with substitution of a halide metal for a parent metal.

The amount of adhesion of a halide metal onto the surface of the parent metal is controlled by applied voltage, period of time for applying voltage, or the like. For instance, in the case where cuprous chloride is reacted with the surface of aluminum, around 30 g/m$^2$ or more of adhesion of the halide metal is preferable.

In this embodiment of the method for coating metal with a dissimilar metal, the step of adhering a finely powdered metal on the surface of the parent metal is carried out by the use of static electricity. Therefore, there is no need for utilizing any particular binder as in the former embodiment of the invention and differing from a conventional method. Thus, the latter embodiment of this invention can also achieve a simplicity of the processes and elevation in the productivity rate, and a uniform adhesion can be attained by the embodiment. More specifically, the latter embodiment of the method according to the present invention differs from a conventional method in which a halide metal is adhered onto the surface of a parent metal by the aid of tackiness of a binder, such as a method in which a binder is previously applied on the surface of the parent metal with a thin thickness, and then a powdered halide metal is dusted thereon, whereby the powder of halide metal is permitted to adhere on the parent metal, a method in which a mixture prepared by previously kneading a halide metal with a binder is applied on the surface of the parent metal, or a similar method. That is, the method of the latter embodiment is improved in that a powdered halide metal is allowed to adhere on the surface of a parent metal by the use of static electricity. Hence, a homogeneous adhesion of the finely powdered halide metal can be effected onto the parent metal, and simplicity of the processes and elevation of the productivity rate can be realized, so that a metallic coating layer of a high quality can inexpensively be formed on the parent metal.

Then, the parent metal on the surface of which a powdered halide metal has been permitted to adhere by means of static electricity is heated. The temperature of this heating is arranged to be the one at which substitution of the halide metal for the parent metal arises or a higher temperature. The substitution reaction of the halide metal for the parent metal is carried out under such a heating condition. For instance, in the case of electrostatic adhesion of copper chloride upon aluminum, the copper chloride is heated to a temperature of 370° C. or more. As a manner for such heating, no particular one is required, but the heating may be effected by a suitable method such as convection, radiation or the like method.

In the heating process as described above, a halide metal is permitted to directly adhere to the surface of the parent metal without employing any binder. Accordingly, the present method can overcome wasteful problems such as a requirement of a large amount of energy for decomposing and burning off a binder, or a requirement of a long period of time for heating such binder as in a conventional method. In accordance with the method for coating metal with a dissimilar metal of the present invention, the productivity rate in the production of dissimilar metal coated products can be elevated and in addition, remarkable effects can also be attained from the viewpoint of saving energy.

According to such heating substitution as set forth above, the coated layer of a dissimilar metal formed on the surface of the parent metal consists of an outer thin film layer of the dissimilar metal and an inner alloy layer obtained by diffusing the dissimilar metal into the parent metal. Consequently, the bonding of the thin film of the dissimilar metal with the parent metal is firm, and disadvantages such as peeling, blister and the like of the dissimilar metal hardly occur, so that a metallic coated layer having a higher quality than that of a plated layer obtained by an ordinary electroplating or the like process can be formed on the parent metal.

Then, the parent metal after the heating substitution as mentioned above is cooled, and the residue of the substitution reaction product as well as unreacted residue are removed. By such removal of the residue, a product in which the surface of the parent metal is coated with a desired dissimilar metal can be obtained.

In the method for coating metal with a dissimilar metal according to the latter embodiment of the invention, there is no need for utilizing any binder, thus being different from a coventional method, and a halide metal is directly contacted with a parent metal, thereby to form a dissimilar metallic coated layer. Thus, the above described substitution reaction is rapidly carried out, and the amount of the residue as stated above decreases. In addition, since the residue can simply be released, an operation for removing the residue can easily and instantly be carried out.

In the latter embodiment of the present invention as described above, a metallic product having a dissimilar metal homogeneous coated layer of a high quality with scarce peeling, blister or the like can also be obtained.

Furthermore, in this method, since a halide metal is directly reacted with a parent metal, there is no possibility of having a viscosity decrease of a binder occur prior to the reaction, so that there is neither fluidization of the halide metal nor sagging and running or falling-off thereof, unlike a conventional spreading or coating process, and as a result a coated layer with a good yield and high quality can be formed on the surface of the parent metal.

In the method, since a fine powder of halide metal is directly contacted with a parent metal, no binder is required, unlike a conventional spreading or coating process. Therefore, preparation of such binder with the halide metal and a coating operation of the binder are not necessary and consequently, selection of a material of, or preparation of such binder, or equipment, operating labor and time for practising such steps as stated above and the like become needless in this method, so that simplicity of the operations as well as a reduction in cost can be attained.

Control of the amount of adhesion of halide metal can instantly and precisely be effected, and a uniform coated layer of a dissimilar metal can rapidly be formed on the parent metal. As a result, the method for coating metal with a dissimilar metal according to this invention which has an excellent productivity rate and is easily applicable for assembly-line operation as well as very suitable for industrial mass-production as compared with a conventional method can be obtained.

The method of the present invention is applicable for a parent metal having various shapes, dimensions and the like, particularly suitably applicable for a parent metal to be partially coated (masking is merely required at the time of electrostatic adhesion of a halide metal at ordinary temperatures), a parent metal with a large dimension in which heat easily disappears therein (heating by means of infrared lamps or the like is required upon only a required surface), and a parent metal with a complicated shape so that a considerable period of time is necessary for allowing a powdered halide metal to adhere to the whole surface of the parent metal (the halide metal powder may previously be permitted to adhere on the parent metal with a sufficient period of time).

An example in which the method for coating metal with a dissimilar metal of the invention is actually practised will be described hereinbelow.

Masking was applied onto a central portion on either side of an aluminum plate of 5 mm×100 mm×100 mm as specified in JIS A1060 by means of a polyvinyl tape so as to leave a circular region having a diameter of 50 mm. Thereafter, the aluminum plate thus treated was utilized as an electrode, and a cuprous chloride powder was subjected to electrostatic adhesion in a ratio of 1 g/dm$^2$ by use of an electrostatic gun. After removing the aforesaid masking, the resulting aluminum plate was inserted into an electric furnace heated to 450° C. After 25 minutes, the aluminum plate was taken out of the electric furnace to cool the same, and was washed. Thus, an aluminum product having a copper coating, i.e., a coating of dissimilar metal, merely on the circular region of either side of the aluminum plate on which cuprous chloride had been permitted to adhere was obtained.

As clearly understood from the above description, a method for coating metal with a dissimilar metal which is very suitable for mass production and by which a simplicity of the operations can be attained is obtained in accordance wih the present invention.

What is claimed is:

1. A method for coating metal with a dissimilar metal comprising the steps of:

(a) preheating a surface of a parent metal selected from the group consisting of iron, titanium, aluminum and an alloy thereof at least to a temperature at which substitution of a halide metal selected from the group consisting of copper chloride, tin chloride, zinc chloride, tin iodide, copper bromide effect substitution of said halide metal at said surface of said parent metal;

(c) cooling the resulting product;

(d) removing a residue of said halide metal from said product.

2. A method as defined in claim 1 wherein said parent metal is heated at least to a temperature at which substitution of said halide metal for said parent metal occurs after degreasing and washing the surface of said parent metal.

3. A method as defined in claim 1 wherein said atmosphere containing said halide metal in finely powdered form is heated to a temperature less than the melting point of said halide metal.

4. A method as defined in claim 1 wherein said atmosphere containing said halide metal in finely powdered form, is formed by a process selected from the group consisting of fluidized bed, spraying, use of static electricity, applying mechanical vibration to powder, and suitable combinations thereof.

5. A method for coating metal with a dissimilar metal according to claim 1, wherein the heated surface of said parent metal is exposed to said atmosphere containing said halide metal at room temperature.

6. A method for coating metal with a dissimilar metal according to claim 1, wherein said method is carried out in the absence of binder.

* * * * *